US006956179B2

(12) United States Patent
Gillman et al.

(10) Patent No.: US 6,956,179 B2
(45) Date of Patent: Oct. 18, 2005

(54) ROCKER/PUSHBUTTON SWITCH

(75) Inventors: Uwe Gillman, Berlin (DE); Rainer Maurer, Berlin (DE); Michael Stoffers, Berlin (DE); Klaus Lamm, Berlin (DE); Uwe Immig, Berlin (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 421 days.

(21) Appl. No.: 10/117,958

(22) Filed: Apr. 5, 2002

(65) Prior Publication Data

US 2003/0029707 A1 Feb. 13, 2003

(30) Foreign Application Priority Data

Aug. 7, 2001 (DE) ..... 101 17 596

(51) Int. Cl.[7] ..... H01H 21/08
(52) U.S. Cl. ..... 200/302.3; 200/339
(58) Field of Search ..... 200/302.3, 339, 200/556, 557, 561, 553

(56) References Cited

U.S. PATENT DOCUMENTS

| | | | | |
|---|---|---|---|---|
| 3,654,415 A * | 4/1972 | Hawkins et al. | ..... | 200/302.3 |
| 5,603,400 A | 2/1997 | Goto et al. | ..... | 200/302.3 |
| 5,660,270 A * | 8/1997 | Martin et al. | ..... | 200/302.3 |
| 5,902,972 A * | 5/1999 | Nestor et al. | ..... | 200/339 |

FOREIGN PATENT DOCUMENTS

| | | | | |
|---|---|---|---|---|
| EP | 0604837 A1 * | 12/1993 | ..... | 200/553 |
| GB | 2241383 A | 8/1991 | | |

* cited by examiner

*Primary Examiner*—Renee Luebke
(74) *Attorney, Agent, or Firm*—Peter Van Winkle

(57) ABSTRACT

A switch has a housing (11), a pair of switching units (17, 18) with buttons (19) that can be depressed to operate each switch unit, and a rocker (23) pivotally mounted on the housing to pivot clockwise and counterclockwise from a neutral position. An elastomeric diaphragm (30) mounted on a top wall (12) of the housing, extends across an aperture (13) in the housing, with first and second lower parts (28, 29) of the rocker passing through the diaphragm to rest closely above the buttons on the switch units. The diaphragm not only largely seals the switch units, but biases the rocker towards the neutral position.

2 Claims, 3 Drawing Sheets

ROCKER/PUSHBUTTON SWITCH

CROSS-REFERENCE TO RELATED APPLICATION

Application claims priority from German patent application No. 101 17 596.5 filed Apr. 7, 2001.

BACKGROUND OF THE INVENTION

Rocker and/or push button switches enable the operation of selected switch parts. It would be valuable if such switches could be constructed in a simple and low cost design. It would be desirable if an actuator-biasing coil spring could be eliminated and if individual self-contained switch units with depressable buttons could be used.

SUMMARY OF THE INVENTION

In accordance with one embodiment of the present invention, a switch is provided which has first and second switching units or parts mounted in a housing and a rocker pivotally mounted on the housing to operate one or the other of at least two switching parts, wherein the switch is of simple and low cost construction. An elastomeric diaphragm that is mounted on a top wall of the housing, not only provides a seal, but also biases the rocker toward a neutral position while allowing it to pivot in opposite directions to operate a selected switch part. Each switch part is formed by a self-contained switching unit. The rocker can be allowed to not only pivot, but to be depressed to simultaneously operate all switch units.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
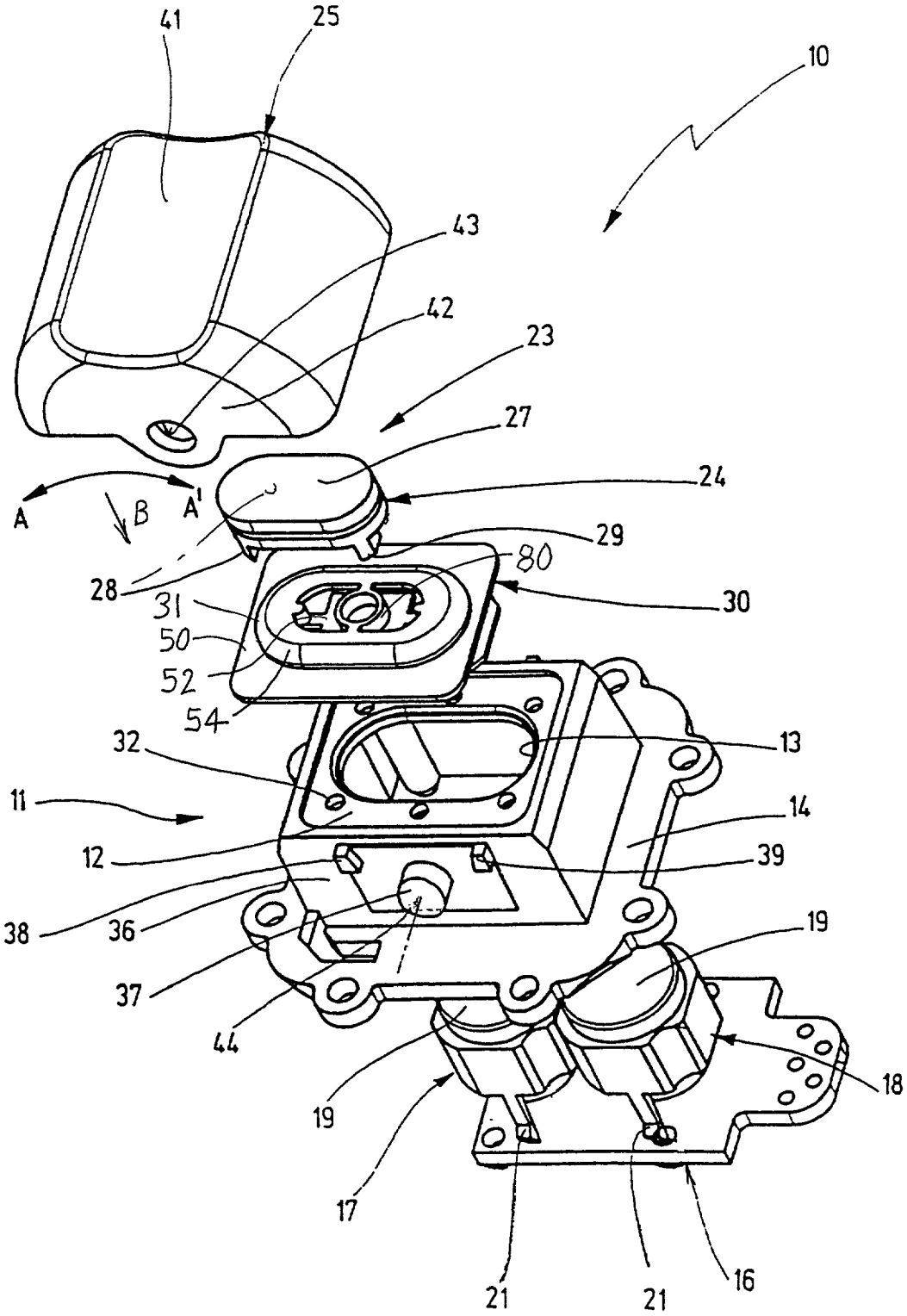
FIG. 1 is an exploded isometric view of a switch constructed in accordance with one embodiment of the present invention.
Figure 3:
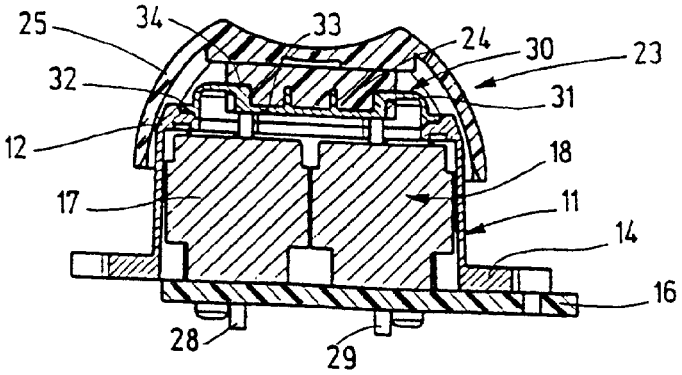
FIG. 3 is a sectional view taken on line III—III of FIG. 2.
Figure 2:
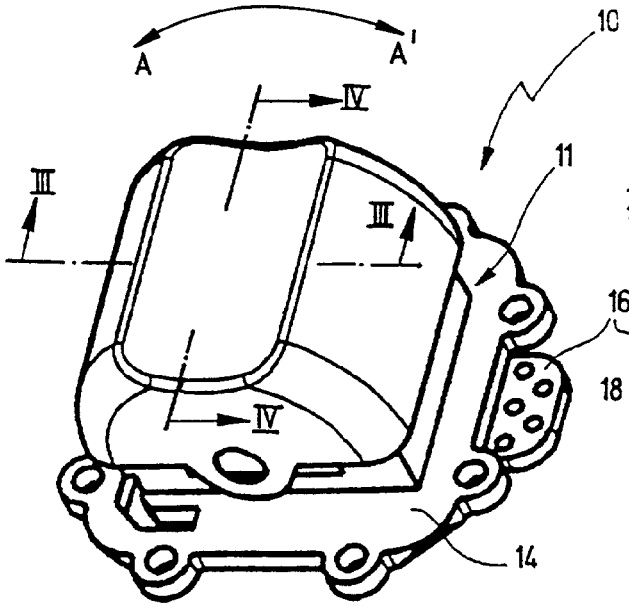
FIG. 2 is a top isometric view of the assembled switch of FIG. 1.
Figure 4:
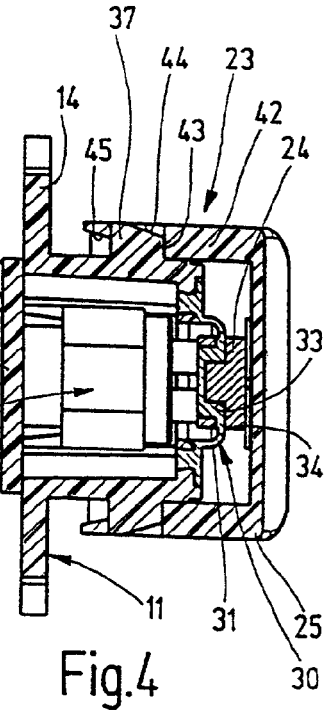
FIG. 4 is a sectional view taken on line IV—IV of FIG. 2.

FIG. 1 illustrates a switch 10 of a type that has an actuating device or rocker 23 with a rocker member 25 that can be pivoted clockwise A' and counterclockwise A from a neutral position. The rocker is mounted on a housing 11 which holds first and second switch units 17, 18, each switch unit having a button 19 that can be depressed to operate the switch, as to close or open it. The housing has top and bottom walls 12, 14 and side walls 36 that largely surround the switch units. The top wall 12 has an aperture 13 that enables the rocker 23 to operate a selected one of the two switch units.

The rocker 23 includes a force-transfer member which lies under the rocker member 25. The force transfer member has a pair of first parts 28 and a pair of second parts 29. The first and second parts respectively lie closely above the buttons 19 of the first and second switch units.

The switch units 17, 18 are mounted on a circuit board 16, as by latch legs 21 that fit through holes in the board, the switch unit having terminals that can be soldered to conductive traces on the circuit board. The circuit board serves as a bottom wall that closes the bottom of a cavity formed between the top and side walls.

The rocker member 25 has opposite end walls 42 with holes 43. When the rocker member is pressed down around the upper portion of the housing, trunnions 37 that project from opposite ends of the housing side walls snap into the holes, the trunnions having inclined end faces 44 to facilitate such snap in. Thereafter, the rocker member can pivot on the trunnions.

The switch includes an elastomeric diaphragm 30 with a peripheral portion 50, a center portion 52, and a connecting portion 54 that connects the peripheral and center portions. The peripheral portion 50 lies on the top wall 12 of the housing and is fastened to the housing thereat. The center portion 52 lies against a bottom portion of the force transfer member 24. The connecting portion 54 is free to deform and move up and down.

Figure 3A:
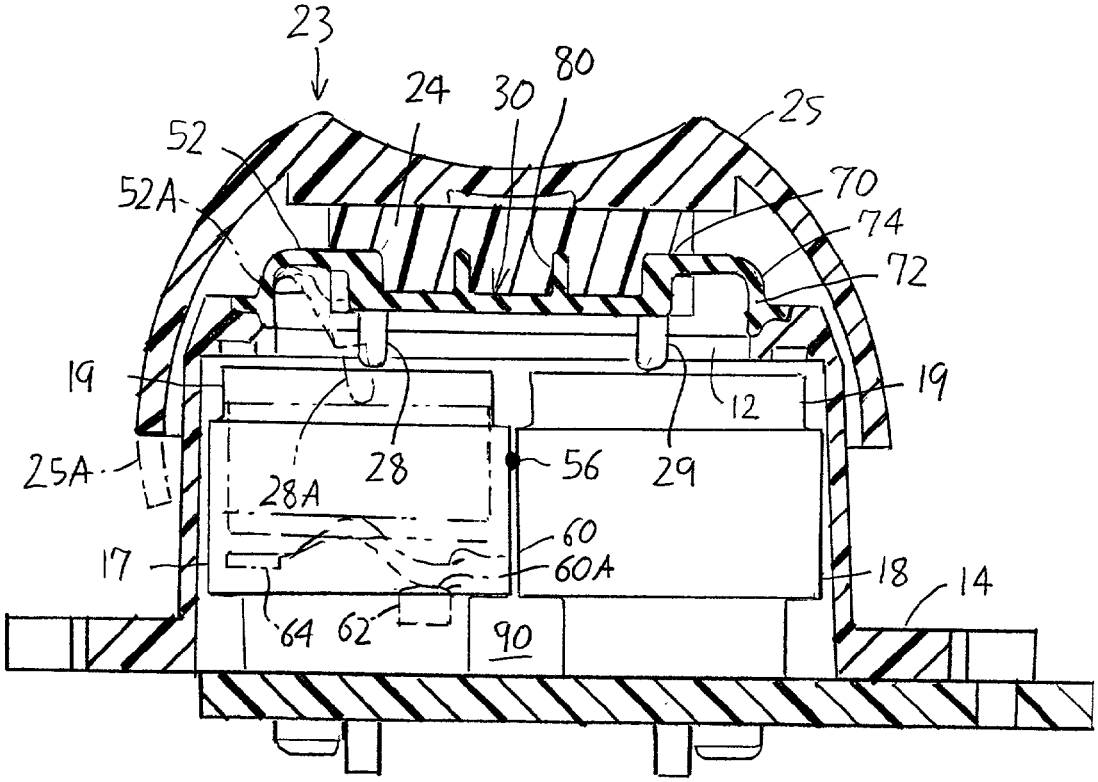
FIG. 3A is an enlarged sectional view of the switch of FIG. 3, and showing, in phantom lines, the rocker pivoted counterclockwise from the neutral position.

FIG. 3A shows that the lower parts 28, 29 of the rocker project through holes in the elastomeric diaphragm 30 to directly contact the buttons 19 of the switch units 17, 18. The connecting portion 52 of the diaphragm is unsupported, so it is free to deflect.

FIG. 3A shows, in phantom lines, the rocker member 25 after it has deflected counterclockwise about a pivot axis 56 to position 25A. The first pair of rocker lower parts 28 have moved down to the position 28A, wherein they have moved down the button 19 to operate the switch unit 17. In the example indicated in FIG. 3A, this has caused a resilient contact element 60 of the switch unit to deflect to the position 60A wherein it has engaged a second contact 62 to close a circuit between first and second contacts 64, 62. The resilience of the contact element 60 returns the button 19 to its original upward position when the rocker no longer depresses the button, but with only sufficient force to raise the button. The connecting portion 52 of the elastomeric diaphragm deflects to the configuration 52A when the rocker has deflected, with the opposite side of the connecting portion 52 being deflected upwardly. The deflection of the elastomeric diaphragm results in a spring force that returns the rocker 23 to its neutral position shown in solid lines in FIG. 3A. The connecting portion 52 of the diaphragm has inner and outer connecting portion ends 70, 72. The connecting portion has a step 74 in height above the housing top and bottom walls 12, 14 between the connecting portion ends, the step also being free to deflect. This results in bending of the connecting portion, with very little stretching or compression (except what results from bending) when the connecting portion deflects as a result of pivoting of the rocker. The step could be a downstep with the middle of the connecting portion lying below the peripheral portion.

Figure 3B:
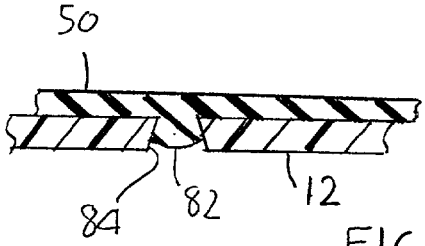
FIG. 3B is a sectional view of a portion of the assembled switch of FIG. 1.

FIG. 1 shows that the diaphragm center portion 52 has a ring-shaped part 80, and FIG. 3A shows that the ring-shaped part 80 is closely received in a largely ring-shaped slot in the force transfer member 24, to help fix the diaphragm center portion to the rocker. FIG. 3B shows that the peripheral portion 50 of the diaphragm has a plurality of downwardly projecting posts 82 that fit into holes 84 that are preferably undercut, in the top wall 12 of the housing and are trapped therein. This helps to hold down the peripheral portion of the diaphragm securely to the top wall. The diaphragm not only provides a spring function, and can be the only spring or can add to the spring force applied by a separate spring. In addition, the diaphragm largely seals the top of the housing to minimize the passage of dust and other unwanted material into the cavity 90 formed within the housing. The diaphragm may not be a hermetic seal, but it prevents the entrance of most dust, vapor, etc.

Figure 5A:
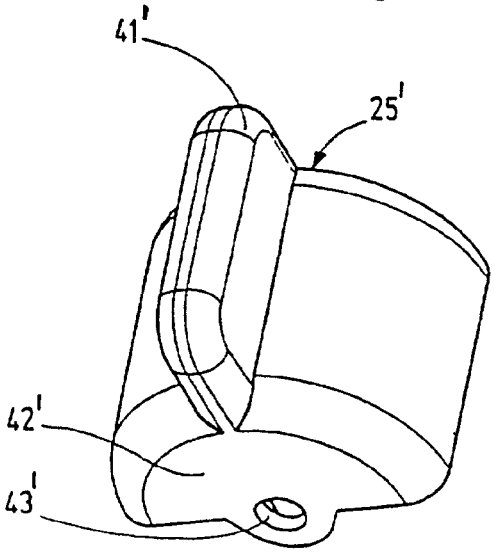
FIG. 5A is an isometric view of a rocker of another embodiment of the invention, with an upstanding projection.

In FIG. 1, the rocker member 25 has a concave upper surface 41 that can receive the thumb or other finger of a person to rock the rocker. FIG. 5A illustrates another rocker 25' with an upstanding web-like projection that can be pushed to one side or the other by a person's thumb or other finger.

Figure 5B:
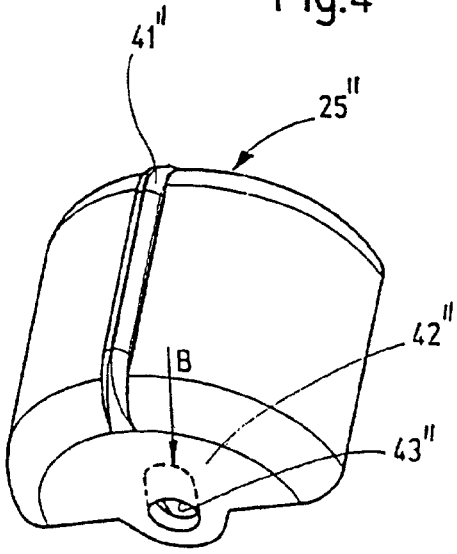
FIG. 5B is a view similar to that of FIG. 5A, but with a smaller upstanding projection, and indicating, in phantom lines, a vertically elongated pivot hole to enable the rocker to be depressed.

FIG. 5B shows a rocker similar to that of FIG. 5A, but with a shorter web 41". FIG. 5B also shows, in phantom lines, a hole 43' that is vertically elongated. This allows the rocker assembly with such a rocker member 25", to be pushed downward, to simultaneously operate both first and second switch units 17, 18 of FIG. 1. Of course, the rocker member 25 of FIG. 1 can be provided with a similar vertically-elongated slot so in a neutral position of the rocker it can be depressed in the downward direction of arrow B to operate both switched.

While terms such as "top", "down", etc. have been used to help describe the invention as it is illustrated, it should be understood that the switch can be used in any orientation with respect to the Earth.

Thus, the invention provides a switch with a rocker that can be pivoted clockwise and counterclockwise from a neutral position to operate a first or second switch unit, which is of low cost and simple and small size. An elastomeric diaphragm mounted on a top wall of the housing and extending across an aperture in the top wall, largely seals the cavity formed within the housing while providing a spring function that biases the rocker toward a neutral position. The elastomeric diaphragm has a peripheral portion mounted on the top wall around the diaphragm, a center portion connected to the rocker, and a connecting portion which is free to deflect and which connects the peripheral and center portions. The connecting portion preferably has a step to facilitate deformation when the rocker rocks, with minimal stretching or compression but substantially only elastic deformation. Each of the switch units is preferably a self contained unit with a button that can be depressed to operate the switch, as to close it, and with the switch unit biasing the button upwardly to its initial position when not depressed.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A switch that includes a housing having side walls and a top wall, said top wall having an aperture, first and second electrical switch units mounted in the housing in said aperture, each switch unit having a depressable part that can be depressed to operate the switch, a rocker assembly which is pivotally mounted on said housing to pivot clockwise and counterclockwise about a horizontal axis from a neutral position, said axis lying on a vertical plane, and said rocker including an upper part lying above said housing, wherein;

said rocker assembly has a lower portion with first and second lower parts that lie on horizontally opposite sides of said vertical plane and closely above said depressable parts of said first and second switch units, respectively, so when said rocker assembly pivots clockwise and counterclockwise about said axis from said neutral position, said lower parts move primarily vertically to depress the depressable parts of said first and second switch units, respectively;

an elastomeric diaphragm mounted on said housing top wall and extending across said aperture therein and substantially sealing said aperture;

said lower parts of said rocker assembly each extends through and below said diaphragm and each of said lower parts lies in constant substantial engagement with one of said depressable parts of said switch units to depress it or allow it to move up.

2. A switch that includes a housing having side walls and a top wall with a face, said top wall having am aperture, first and second electrical switch units mounted in the housing, each switch unit having a depressable part that can be depressed to operate the switch, a rocker assembly which is pivotally mounted on said housing to pivot clockwise and counterclockwise about an axis from a neutral position, said axis lying on a vertical plane, and said rocker including an upper part lying above said housing, said rocker assembly having a lower middle face, and said rocker assembly positioned so when it pivots clockwise and counterclockwise about said axis from said neutral position it depresses the depressable parts of said first and second switch units, respectively, including:

an elastomeric diaphragm having an outer diaphragm portion mounted facewise against said housing top wall face and extending across said aperture therein, having an inner diaphragm portion that lies facewise against said rocker assembly lower face, and having a connection portion that connects said inner and outer diaphragm portions and that has a primarily vertical step with one end of the step higher than the opposite end, said step being free of engagement with any other part of the switch so it can freely move up and down; and wherein said diaphragm has a pair of holes and said rocker assembly has a pair of posts that lie on opposite sides of said axis and project downward through said diaphragm holes and against said depressable parts of said switch units.

* * * * *